US011572892B2

(12) United States Patent
Petryszak

(10) Patent No.: US 11,572,892 B2
(45) Date of Patent: Feb. 7, 2023

(54) REINFORCED BLOWER HOUSING COMPONENT FOR ARRANGEMENT ON A GAS BLOWER

(71) Applicant: ebm-papst Landshut GmbH, Landshut (DE)

(72) Inventor: Christian Petryszak, Freising (DE)

(73) Assignee: ebm-papst Landshut GmbH, Landshut (DE)

( * ) Notice: Subject to any disclaimer, the term of this patent is extended or adjusted under 35 U.S.C. 154(b) by 321 days.

(21) Appl. No.: 16/894,814

(22) Filed: Jun. 7, 2020

(65) Prior Publication Data

US 2020/0392969 A1 Dec. 17, 2020

(30) Foreign Application Priority Data

Jun. 11, 2019 (DE) ..... 102019115741.2

(51) Int. Cl.

| | |
|---|---|
| ***F04D 29/40*** | (2006.01) |
| ***F04D 29/42*** | (2006.01) |
| ***F04D 29/62*** | (2006.01) |
| *F04D 25/08* | (2006.01) |

(52) U.S. Cl.

CPC ..... *F04D 29/403* (2013.01); *F04D 29/4226* (2013.01); *F04D 29/624* (2013.01); *F04D 25/08* (2013.01)

(58) Field of Classification Search

CPC ..... F04D 29/403; F04D 29/4226; F04D 29/4206; F04D 29/441; F04D 29/624; F04D 29/626; F05D 2210/12; F05D 2210/14

See application file for complete search history.

(56) References Cited

U.S. PATENT DOCUMENTS 885,108 A * 4/1908 Trent ..... F04D 29/4226 415/206
5,443,364 A * 8/1995 Mistry ..... F04D 29/626 415/214.1
7,210,903 B2 * 5/2007 Lyons ..... F04D 29/422 415/206
9,726,193 B2 * 8/2017 Koning ..... F04D 7/04

FOREIGN PATENT DOCUMENTS

WO WO2009/103606 8/2009

OTHER PUBLICATIONS

German Search Report dated Feb. 11, 2020.

* cited by examiner

*Primary Examiner* — Courtney D Heinle
*Assistant Examiner* — Danielle M. Christensen
(74) *Attorney, Agent, or Firm* — Dickinson Wright PLLC

(57) ABSTRACT

The disclosure relates to a blower housing component with a housing body and a mounting flange extending radially outward from the housing body, at which mounting flange multiple mounting points are arranged for mounting the blower housing component, which mounting points are evenly spaced in the circumferential direction, wherein radial ribs extending radially in a straight line along the mounting flange are formed between the housing body and the mounting points, and wherein the radial ribs are intersected by tangential ribs extending along the mounting flange, which tangential ribs extend tangentially to the housing body between two of the mounting points, respectively, and connect the two mounting points, respectively.

15 Claims, 3 Drawing Sheets

REINFORCED BLOWER HOUSING COMPONENT FOR ARRANGEMENT ON A GAS BLOWER

RELATED APPLICATIONS

This application claims priority to German Application No. DE 10 2019 115 741.2, filed Jun. 11, 2019, the entire contents of which are incorporated herein by reference in their entirety.

FIELD

The disclosure relates to a blower housing component with a housing body and a mounting flange extending radially outward from the housing body with multiple mounting points.

BACKGROUND

The disclosure relates to a blower housing component with a housing body and a mounting flange extending radially outward from the housing, at which mounting flange multiple mounting points are arranged for mounting the blower housing component to a gas blower, which mounting points are evenly spaced in the circumferential direction. Such blower housing components with gas connection are known from the state of the art and are frequently made of plastic. In this context, we have found that it is necessary to ensure that the stiffness is sufficiently high and material use is low.

BRIEF SUMMARY

Therefore, the problem underlying the disclosure is to provide a blower housing component for a gas blower, the bending stiffness of which housing component is increased.

This problem is solved by the combination of characteristics according to claim 1.

According to the disclosure, a blower housing component is proposed with a housing body and a mounting flange extending radially outward from the housing body, at which mounting flange multiple mounting points are arranged for mounting the blower housing component, which mounting points are evenly spaced in the circumferential direction. Radial ribs extending radially in a straight line along the mounting flange are formed between the housing body and the mounting points. These radial ribs are intersected by tangential ribs extending along the mounting flange, which tangential ribs in turn extend tangentially to the housing body between two of the mounting points, respectively, and connect the two mounting points, respectively.

Each mounting point is associated with a radial rib to increase radial stiffness. In addition, the tangential stiffness is increased by means of the tangential ribs, such that a transverse ribbing with enhanced stiffness is formed around the housing body at the mounting flange as a result. Bolt-receiving points formed by material-reinforced openings in the mounting flange preferably serve as mounting points to receive bolts. The ribs preferably are panel-shaped or disc-shaped.

In a preferred embodiment, the radial ribs extend radially outward from the lateral surface of the housing body to the respective mounting point and engage with a radially inward-facing side of the respective mounting point. The tangential ribs therein are radially spaced apart from the housing body and in particular engage with the respective mounting points on a side oriented in the circumferential direction.

Furthermore, the tangential ribs, seen in an axial top view, extend tangentially to the housing body and in sections around the housing body, i.e., the tangential ribs extend tangentially from one mounting point to the housing body and then extend tangentially outward from the housing body toward the next mounting point. Thus, two mounting points are always reinforced by at least one tangential rib.

In an advantageous embodiment, it is provided that each of the radial ribs is intersected by at least one tangential rib. However, the disclosure also teaches that individual or all radial ribs are intersected by multiple tangential ribs.

Further, an exemplary embodiment of the blower housing component is characterized in that the radial ribs and the tangential ribs alternately penetrate each other in the circumferential direction. At the intersection points of radial ribs and tangential ribs, the radial rib partly passes through the tangential rib, and the tangential rib partly passes through the radial rib, such that one of the two ribs passes over the respective other rib at axial height at the intersection point.

Further, an embodiment is favorable, in which at least three mounting points are provided, which are arranged at a 120° distance to each other in the circumferential direction at a radial outer edge of the mounting flange. A further development also provides that two groups of mounting points are provided in an arrangement of three points per group spaced apart by 120° in the circumferential direction. Thus, the blower housing component can be fastened to the gas blower at two mounting positions on the gas blower rotated in the circumferential direction relative to each other. Therein, an embodiment is advantageous, in which each two respectively adjacent mounting points are arranged at an angular distance of 30° to each other in the circumferential direction. This results in six mounting points total, of which the respective adjacent points have an angular distance of 30° to each other, wherein the two groups formed by three respective mounting points form mounting points at a 120° angular distance.

A further development of the blower housing component furthermore provides that the tangential ribs also intersect. In particular, a solution with two groups and thus a total of six mounting points will provide additional reinforcement in this manner.

It is also advantageous when each of the radial ribs in the blower housing component is intersected by at least one tangential rib.

Regarding the geometric design, the problem is solved particularly advantageously when an axial height of the radial ribs steadily decreases along the radially outward extension. The tangential ribs favorably have an axial height h, which is in proportion to a direct distance b between two mounting points, such that $0.2 \leq h/b \leq 0.4$. Furthermore, it is geometrically advantageous if the tangential ribs extend between two mounting points such that they first increase in axial height and subsequently decrease in the same. A vertex defining the transition between the ascending and descending gradient has a radius R, which is in proportion to the direct distance b between two mounting points, such that $0.1 \leq R/b \leq 0.3$.

The blower housing component described here preferably is formed as a diffuser housing for an arrangement attaching to a gas blower, wherein the housing body forms a diffuser with a suction opening and a flow outlet provided at the mounting flange for inflow into the gas blower. In addition, a fuel gas connection is provided on the housing body.

BRIEF DESCRIPTION OF THE DRAWINGS

Other advantageous further developed embodiments of the disclosure are characterized in the dependent claims and/or are described in more detail through the drawings in conjunction with the description of the preferred embodiment of the disclosure. The drawings show:

DETAILED DESCRIPTION

Figure 1:
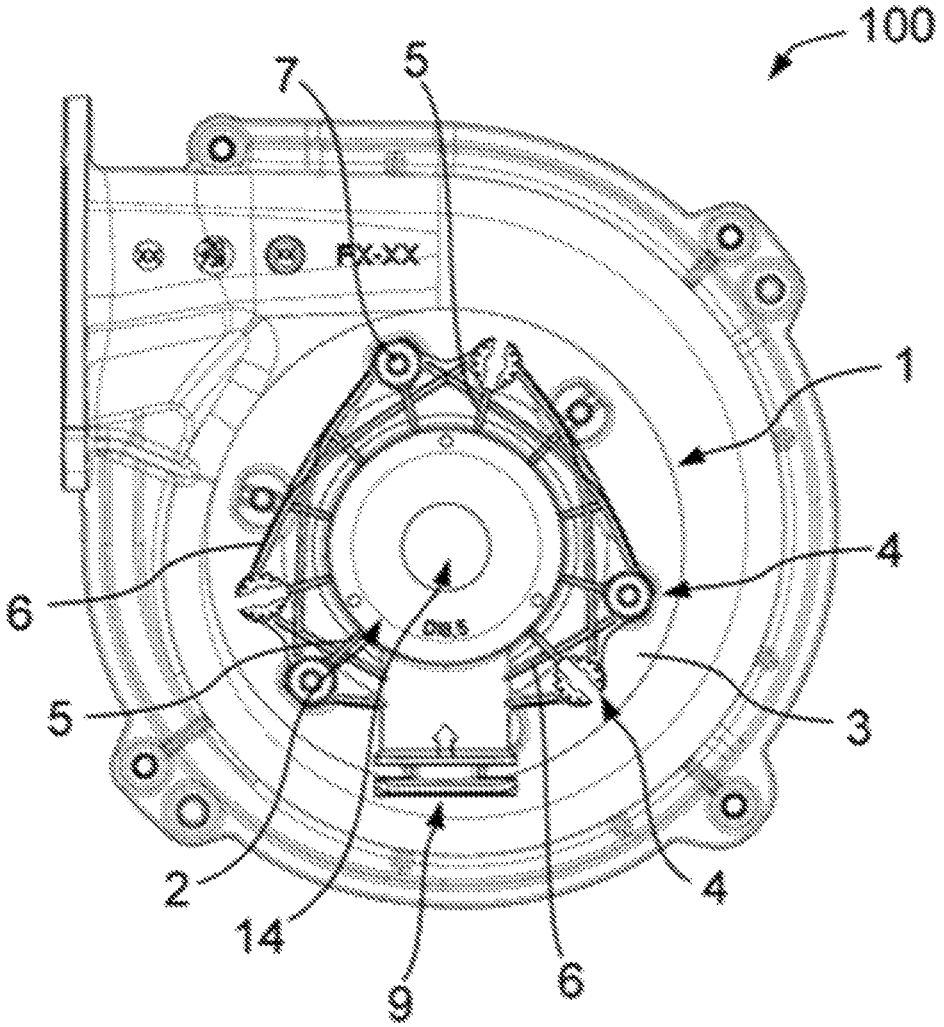
FIG. 1 An axial top view of a gas blower with a blower housing component attached to it.

In FIG. 1, a gas blower 100 with an attached blower housing component 1 is designed as a diffuser housing with a suction opening 14 for ambient air and a fuel gas connection 9.

Figure 2:
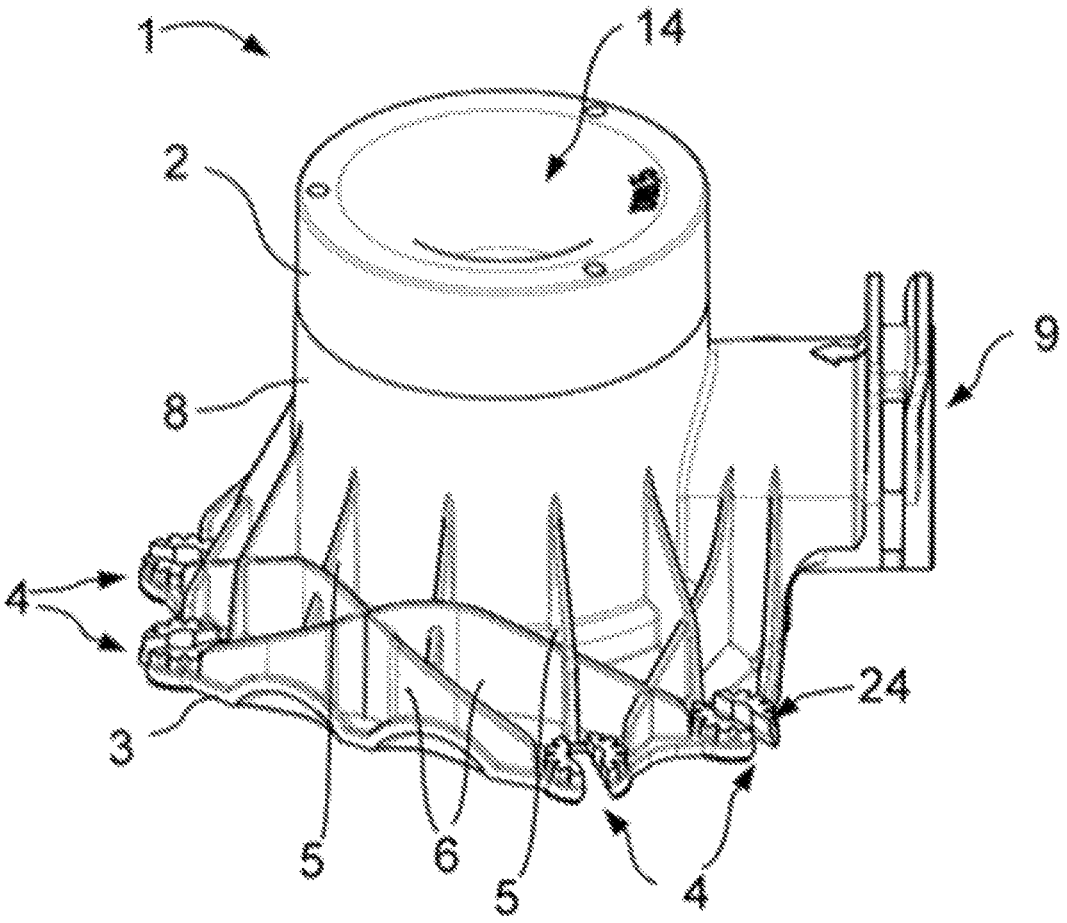
FIG. 2 A perspective view of the blower housing component from FIG. 1.
Figure 3:
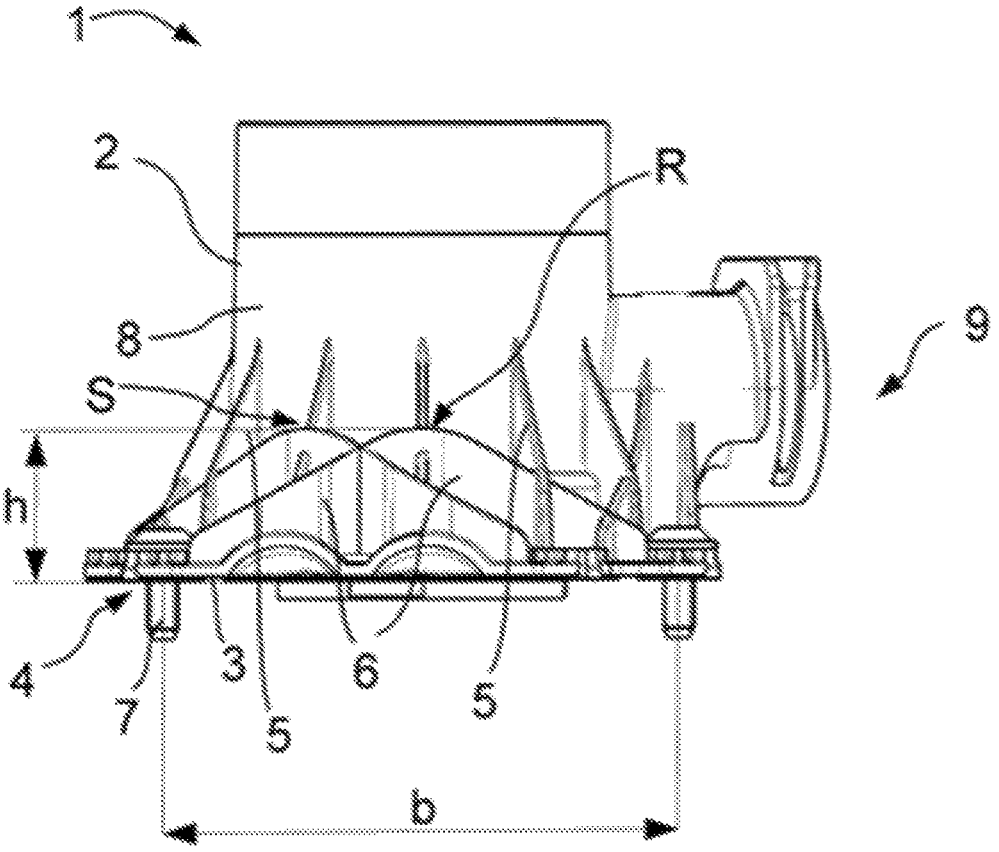
FIG. 3 A side view of the blower housing component from FIG. 2.

The blower housing component 1 shown in FIGS. 1-3 comprises the essentially cylindrical housing body 2 which is arranged on a mounting flange 3 on an axial end side, wherein the mounting flange 3 extends radially outward beyond the housing body 2. The mounting flange 3 is the component with which the blower housing component 1 is fastened to the gas blower 100 by means of bolts 7 via the mounting points 4 formed as bolt-receiving points. Three groups of two mounting points 4 each are provided at the mounting flange 3, distributed in the circumferential direction, the groups of mounting points 4 being spaced apart at an angle of 120° in the circumferential direction. Immediately adjacent mounting points 4 within a group are again spaced at an angle of 30°, such that two mounting positions rotated to each other by 30° of the blower housing component 1 at the gas blower 100 result and are feasible.

A radial rib 5 extends radially outward from the lateral surface 8 of the housing body 2 to each of the mounting points 4. In addition, radial ribs 5 are also provided in intermediate areas, which end at the radial, free surrounding edge of the mounting flange 3. Furthermore, the tangential ribs 6 extend, and intersect the radial ribs 5, between respectively adjacent mounting points 4 of the two groups each having three mounting points 4. As clearly shown in FIG. 2, the radial ribs 5 and the tangential ribs 6 alternately penetrate each other, and end at the respective material reinforcement 24 of the mounting points 4. FIG. 2 also clearly shows that the tangential ribs 6 also intersect. The resulting transverse ribbing provides a high stiffness in the radial direction and tangential direction.

The tangential ribs 6 are radially spaced apart from the housing body 3 and extend tangentially toward the housing body 3 from the respective mounting point 4.

Referring to FIG. 3, the advantageous geometric details are specified in more detail, according to which the axial height of the radial ribs 5 continuously decreases from the lateral surface 8 radially outward to the mounting points 4. The tangential ribs 6 have an axial height h, which is proportional to a direct distance b between two mounting points 4 of a group, such that h/b=0.28. Alternatively, the ratio is set in a range of 0.2-0.4. The contour of the tangential ribs 6 between two fastening points 4, as seen from the side, is that of an arc that first ascends and then descends with regards to its axial height. At the vertex S, there is a radius R, which is in proportion to the direct distance b between two mounting points 4 of a group, such that R/b=0.2. Alternatively, the ratio is set in a range of 0.1-0.3.

The invention claimed is:

1. A blower housing component with a housing body defining a longitudinal axis and a mounting flange extending radially outward from the housing body, at which mounting flange multiple mounting points are arranged for mounting the blower housing component, which mounting points are evenly spaced in a circumferential direction relative to the longitudinal axis, wherein radial ribs extending radially in a straight line along the mounting flange are formed between the housing body and the mounting points, and wherein the radial ribs are intersected by tangential ribs extending along the mounting flange, which tangential ribs extend tangentially to the housing body between two of the mounting points, respectively, and connect the two mounting points, respectively.

2. The blower housing component according to claim 1, wherein the tangential ribs extend radially spaced apart from the housing body.

3. The blower housing component according to claim 1, wherein the tangential ribs extend tangentially to the housing body and in sections around the housing body.

4. The blower housing component according to claim 1, wherein each of the radial ribs is intersected by at least one tangential rib.

5. The blower housing component according to claim 1, wherein the radial ribs and the tangential ribs alternately penetrate each other in the circumferential direction.

6. The blower housing component according to claim 1, wherein at least three mounting points are provided, which are arranged at a 120° distance to each other in the circumferential direction at a radial outer edge of the mounting flange.

7. The blower housing component according to claim 1, wherein three groups of mounting points are provided in an arrangement of two points per group spaced apart by 120° in the circumferential direction.

8. The blower housing component according to claim 7, wherein two adjacent mounting points in at least one of the three groups of mounting points are arranged at an angular distance of 30° in the circumferential direction to each other.

9. The blower housing component according to claim 1, wherein one tangential rib intersects another adjacent tangential rib.

10. The blower housing component according to claim 1, wherein each of the radial ribs is intersected by at least one tangential rib.

11. The blower housing component according to claim 1, wherein an axial height of the radial ribs steadily decreases along the radially outward extension.

12. The blower housing component according to claim 1, wherein the tangential ribs have an axial height h, which is in proportion to a direct distance b between two mounting points, such that $0.2 \leq h/b \leq 0.4$.

13. The blower housing component according to claim 1, wherein a gradient of the tangential ribs between two mounting points first ascends and then descends with regard to its axial height, wherein a vertex (S) defining a transition between the ascending and descending gradient has a radius R, which is in proportion to the direct distance b between two mounting points, such that $0.1 \leq R/b \leq 0.3$.

14. The blower housing component according to claim 1, wherein the blower housing component is formed as a diffuser housing for an arrangement attaching to a gas blower, wherein the housing body forms a diffuser with a suction opening and a flow outlet provided at the mounting flange for inflow into the gas blower.

15. A gas blower with the blower housing component according to claim 1.

* * * * *